US012084753B2

(12) United States Patent
Li et al.

(10) Patent No.: US 12,084,753 B2
(45) Date of Patent: Sep. 10, 2024

(54) AMORPHOUS ALLOY-REINFORCED AND TOUGHENED ALUMINUM MATRIX COMPOSITE AND PREPARATION METHOD THEREOF

(71) Applicant: Kunming University of Science and Technology, Kunming (CN)

(72) Inventors: Lu Li, Kunming (CN); Guojian Lin, Kunming (CN); Xiuchang Wang, Kunming (CN); Zhengwei Guo, Kunming (CN); Chuanyong Li, Kunming (CN); Xingguo Zhang, Kunming (CN); Zhentao Yuan, Kunming (CN)

(73) Assignee: Kunming University of Science and Technology, Kunming (CN)

( * ) Notice: Subject to any disclaimer, the term of this patent is extended or adjusted under 35 U.S.C. 154(b) by 0 days.

(21) Appl. No.: 18/112,075

(22) Filed: Feb. 21, 2023

(65) Prior Publication Data

US 2023/0416894 A1 Dec. 28, 2023

(30) Foreign Application Priority Data

Jun. 22, 2022 (CN) ..... 202210712185.3

(51) Int. Cl.

| | |
|---|---|
| ***C22C 45/08*** | (2006.01) |
| ***C22C 1/04*** | (2023.01) |
| ***C22F 1/04*** | (2006.01) |

(52) U.S. Cl.

CPC ..... *C22C 45/08* (2013.01); *C22C 1/0416* (2013.01); *C22F 1/04* (2013.01); *C22C 2200/02* (2013.01)

(58) Field of Classification Search

None

See application file for complete search history.

(56) References Cited

FOREIGN PATENT DOCUMENTS

| | | | |
|---|---|---|---|
| CN | 109868392 A | * | 6/2019 |
| JP | 07113101 A | * | 5/1995 |
| WO | 9719774 A1 | | 6/1997 |

OTHER PUBLICATIONS

English language machine translation of JP-07113101-A. Generated Feb. 12, 2024. (Year: 2024).*

English language machine translation of CN-109868392-A. Generated Feb. 12, 2024. (Year: 2024).*

Anderson et al. "7075 and Alclad 7075." ASM Handbook, vol. 2B, Properties and Selection of Aluminum Alloys. pp. 432-438. 2019. (Year: 2019).*

Samal et al. "Extrusion of Metal Powders." ASM Handbook, vol. 7, Powder Metallurgy. pp. 277-285. 2015. (Year: 2015).*

* cited by examiner

*Primary Examiner* — Brian D Walck

(74) *Attorney, Agent, or Firm* — Troutman Pepper Hamilton Sanders LLP; Christopher C. Close, Jr.

(57) ABSTRACT

Provided are an amorphous alloy-reinforced and toughened aluminum matrix composite (AMC) and a preparation method thereof. The amorphous alloy-reinforced and toughened AMC includes 55 vol. % to 95 vol. % of an aluminum-based alloy and 5 vol. % to 45 vol. % of an amorphous alloy, wherein the amorphous alloy is $Fe_{52}Cr_{26}Mo_{18}B_2C_{12}$.

8 Claims, 15 Drawing Sheets

AMORPHOUS ALLOY-REINFORCED AND TOUGHENED ALUMINUM MATRIX COMPOSITE AND PREPARATION METHOD THEREOF

CROSS REFERENCE TO RELATED APPLICATIONS

This patent application claims the benefit and priority of Chinese Patent Application No. 202210712185.3 filed on Jun. 22, 2022, the disclosure of which is incorporated by reference herein in its entirety as part of the present application.

TECHNICAL FIELD

The present disclosure relates to the technical field of metal matrix composites (MMCs), in particular to an amorphous alloy-reinforced and toughened aluminum matrix composite (AMC) and a preparation method thereof.

BACKGROUND ART

Metal matrix composites (MMCs) are composites obtained by artificially combining a metal and its alloys as a matrix with one or several metal or non-metal reinforcements. Most reinforcement materials of the MMC are inorganic non-metals such as ceramics, carbon, graphite, and boron. Furthermore, metal wires could also be used as reinforcement materials of the MMC.

Aluminum matrix composite (AMC), as a kind of the MMCs, has become the mainstream of MMC research and development due to its excellent performance such as high specific strength, desirable specific modulus, well wear resistance, and satisfactory dimensional stability. When preparing the AMC, an aluminum-based alloy matrix is mainly selected from an Al—Cu—Mg aluminum-based alloy and an Al—Mg—Si aluminum-based alloy, while a reinforcement is mainly strengthening particles such as SiC, $TiB_2$, $Al_2O_3$ and graphite particles. These strengthening particles could interact with the aluminum-based alloy matrix, thereby strengthening the material to improve the strength of the AMC. However, cracks are prone to occur at the interface junction and a large number of non-coherent grain boundaries are introduced, resulting in embrittlement and poor toughness of the AMC.

Therefore, it has become an urgent technical problem in the field to simultaneously improve strength and toughness of the AMC.

SUMMARY

An object of the present disclosure is to provide an amorphous alloy-reinforced and toughened AMC and a preparation method thereof. In the present disclosure, the amorphous alloy-reinforced and toughened AMC has better toughness while having high yield strength and elastic modulus, thereby simultaneously improving strength and toughness.

To achieve the above object, the present disclosure provides the following technical solutions.

The present disclosure provides an amorphous alloy-reinforced and toughened AMC, including 55 vol. % to 95 vol. % of an aluminum-based alloy and 5 vol. % to 45 vol. % of an amorphous alloy, wherein the amorphous alloy is $Fe_{52}Cr_{26}Mo_{18}B_2C_{12}$.

In some embodiments, the amorphous alloy-reinforced and toughened AMC includes 60 vol. % to 90 vol. % of the aluminum-based alloy and 10 vol. % to 40 vol. % of the amorphous alloy.

In some embodiments, the amorphous alloy-reinforced and toughened AMC includes 70 vol. % to 80 vol. % of the aluminum-based alloy and 20 vol. % to 30 vol. % of the amorphous alloy.

In some embodiments, the aluminum-based alloy comprises one selected from the group consisting of Al-12Si, a 7075 aluminum alloy, and an Al-9Si-3Cu-0.8Zn alloy.

In some embodiments, the amorphous alloy is prepared by a method including the following steps:

1) mixing an iron powder, a chromium powder, a molybdenum powder, a boron powder, and a carbon powder according to an atomic percentage of each atom of the amorphous alloy to obtain a first mixed powder; and
2) adding a protective agent to the first mixed powder obtained in step 1) to obtain a second mixed powder, and subjecting the second mixed powder to mechanical alloying to obtain the amorphous alloy.

In some embodiments, in step 2), the protective agent is stearic acid, and is used in an amount of 1 wt. % to 2 wt. % of the first mixed powder.

In some embodiments, in step 2), the mechanical alloying is conducted by ball milling in an inert atmosphere.

The present disclosure further provides a method for preparing the amorphous alloy-reinforced and toughened AMC as described in the above technical solutions, including the following steps:

(1) mixing a powder of the aluminum-based alloy with the amorphous alloy to obtain a third mixed powder; and
(2) subjecting the third mixed powder obtained in step (1) to continuous extrusion and heat treatment sequentially to obtain the amorphous alloy-reinforced and toughened AMC.

In some embodiments, in step (2), the continuous extrusion is conducted at a rotational speed of 4 rpm to 10 rpm and a strain capacity of greater than 1.

In some embodiments, in step (2), the heat treatment is conducted by heating an extruded material obtained after the continuous extrusion to a treating temperature of 400° C. to 550° C., and holding at the treating temperature under a pressure of 30 MPa to 60 MPa for 5 min to 15 min.

The present disclosure provides an amorphous alloy-reinforced and toughened AMC, including 55 vol. % to 95 vol. % of an aluminum-based alloy and 5 vol. % to 45 vol. % of an amorphous alloy, wherein the amorphous alloy is $Fe_{52}Cr_{26}Mo_{18}B_2C_{12}$. In the present disclosure, the amorphous alloy is used to replace the traditional reinforcement, and the amorphous alloy is evenly distributed in the aluminum-based alloy, and element diffusion occurs between the amorphous alloy and the matrix metal to form a low-defect and stable interface, reducing the mismatch stress between them, and improving hardness and elastic modulus, thus obtaining an aluminum-based alloy with high strength and excellent toughness. By controlling the ratio of the aluminum-based alloy to the amorphous alloy, a relatively-stable interface relationship could be formed between the reinforcement and the matrix, thus simultaneously improving strength and toughness of the aluminum-based alloy reinforced by the amorphous alloy. The results of examples show that the amorphous alloy-reinforced and toughened AMC has a yield strength of 95 MPa to 400 MPa, an elastic modulus of 370 GPa to 850 GPa, a small strain hardening exponent, and excellent toughness.

In the present disclosure, the amorphous alloy-reinforced and toughened AMC is prepared by continuous extrusion, which has advantages such as a short preparation process, low energy consumption, and high production efficiency; meanwhile, the amorphous alloy also has excellent mechanical properties, and could form a desirable interface with aluminum-based materials.

DETAILED DESCRIPTION OF THE EMBODIMENTS

Figure 1:
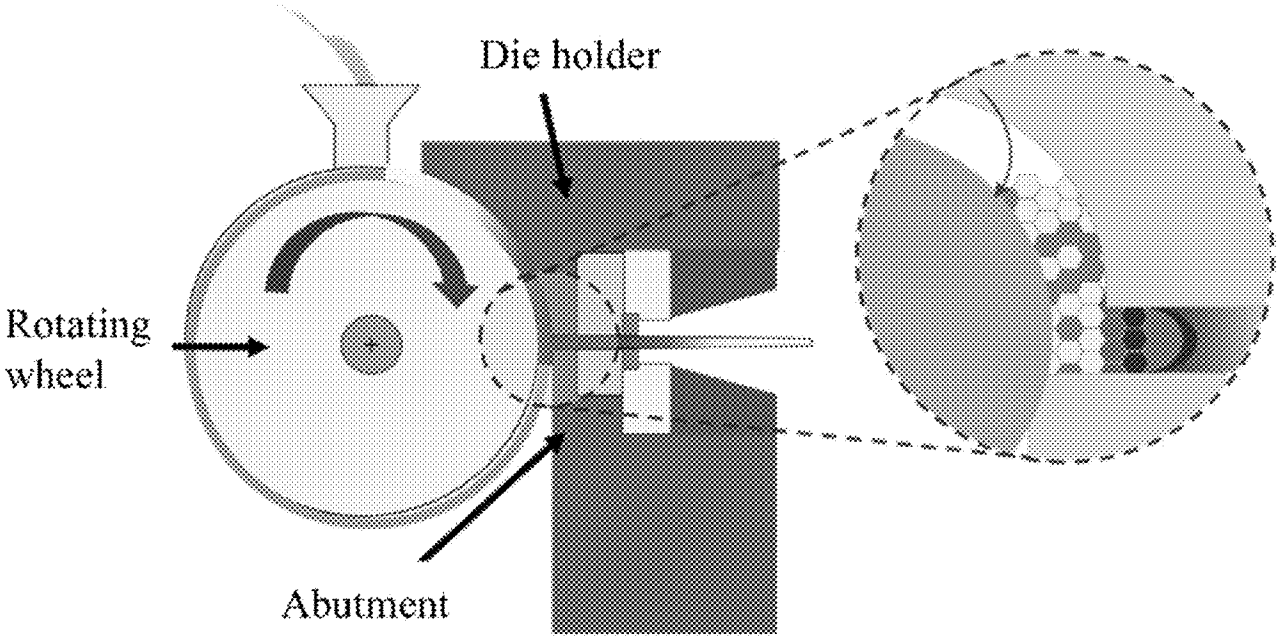
FIG. 1 shows a schematic diagram of continuous extrusion according to some embodiments of the present disclosure.

The present disclosure provides an amorphous alloy-reinforced and toughened AMC, including 55 vol. % to 95 vol. % of an aluminum-based alloy and 5 vol. % to 45 vol. % of an amorphous alloy, wherein the amorphous alloy is $Fe_{52}Cr_{26}Mo_{18}B_2C_{12}$.

In the present disclosure, the amorphous alloy-reinforced and toughened AMC includes 55 vol. % to 95 vol. %, preferably 60 vol. % to 90 vol. %, more preferably 65 vol. % to 85 vol. %, and even more preferably 70 vol. % to 80 vol. % of the aluminum-based alloy. By controlling a volume fraction of the aluminum-based alloy, a relatively stable interface relationship could be formed between the amorphous alloy and the aluminum-based alloy.

In some embodiments, the aluminum-based alloy comprises one selected from the group consisting of Al-12Si, a 7075 aluminum alloy, and an Al-9Si-3Cu-0.8Zn alloy. There is no special limitation on specific source of the aluminum-based alloy, and commercially available products well known to those skilled in the art or self-prepared products may be used. By controlling a composition of the aluminum-based alloy within the above range, the stability of the interface relationship between the amorphous alloy and the aluminum-based alloy could be further improved.

In the present disclosure, the amorphous alloy-reinforced and toughened AMC includes 5 vol. % to 45 vol. %, preferably 10 vol. % to 40 vol. %, more preferably 15 vol. % to 35 vol. %, and even more preferably 20 vol. % to 30 vol. % of the amorphous alloy. By controlling a volume fraction of the amorphous alloy, a relatively stable interface relationship could be formed between the amorphous alloy and the aluminum-based alloy.

In the present disclosure, the amorphous alloy is $Fe_{52}Cr_{26}Mo_{18}B_2C_{12}$. By using the amorphous alloy with the above composition as a reinforcement, element diffusion could occur between the amorphous alloy and the aluminum-based alloy to form a low-defect and stable interface with a core-shell structure, reducing a mismatch stress between the amorphous alloy and the matrix material. Meanwhile, the amorphous alloy particles also play a role in hindering the movement of dislocations, thereby improving the strength-toughness matching of AMC.

In some embodiments, the amorphous alloy is prepared by a method including the following steps:

1) mixing an iron powder, a chromium powder, a molybdenum powder, a boron powder, and a carbon powder according to an atomic percentage of each atom of the amorphous alloy to obtain a first mixed powder; and
2) adding a protective agent to the first mixed powder obtained in step 1) to obtain a second mixed powder, and subjecting the second mixed powder to mechanical alloying to obtain the amorphous alloy.

In some embodiments, an iron powder, a chromium powder, a molybdenum powder, a boron powder, and a carbon powder are mixed according to an atomic percentage of each atom of the amorphous alloy to obtain a first mixed powder. There is no special limitation on the mixing, as long as each component could be mixed uniformly.

In the present disclosure, there is no special limitation on particle sizes of the iron powder, chromium powder, molybdenum powder, boron powder, and carbon powder, which may be selected according to the technical knowledge of those skilled in the art. There is no special limitation on specific source of the iron powder, chromium powder, molybdenum powder, boron powder, and carbon powder, and commercially available products well known to those skilled in the art may be used.

In some embodiments, after obtaining the first mixed powder, a protective agent is added to the first mixed powder to obtain a second mixed powder, and the second mixed powder is subjected to mechanical alloying to obtain the amorphous alloy.

In some embodiments, the protective agent is stearic acid, and is used in an amount of 1 wt. % to 2 wt. %, preferably 1.5 wt. % of the first mixed powder. In some embodiments, stearic acid is used as a protective agent, which could play a role in lubricating and separation, avoiding problems such as agglomeration in ball milling.

In some embodiments, the mechanical alloying is conducted by ball milling. In some embodiments, the ball milling is conducted with a ball-to-material ratio of (20-30):1, preferably 25:1. In some embodiments, the ball milling is conducted at a rotational speed of 500 rpm to 800 rpm, preferably 600 rpm to 700 rpm. In some embodiments, the ball milling is conducted for 120 h to 200 h, preferably 150 h to 180 h. In some embodiments, the ball milling is conducted under an inert atmosphere, preferably argon. By controlling the parameters of the ball milling, rotating mechanical energy could be transferred to the powder during the ball milling, and the powder is impacted, extruded, and repeatedly broken during the rotating, thus obtaining dispersed ultrafine particles and achieving alloying in the solid state.

In some embodiments, the amorphous alloy has a particle size of greater than or equal to 200 mesh. In the present disclosure, controlling the particle size of the amorphous alloy within the above range is beneficial to subsequent thorough mixing with the aluminum-based alloy.

In the present disclosure, an amorphous alloy is used to replace the traditional reinforcement, amorphous alloy particles are evenly distributed in an aluminum-based alloy, and element diffusion occurs between the amorphous alloy and the matrix metal to form a low-defect and stable interface, reducing the mismatch stress between them, and improving hardness and elastic modulus, thus obtaining an aluminum-based alloy with high strength and excellent toughness. By controlling a ratio of the aluminum-based alloy to the amorphous alloy, a relatively-stable interface relationship could be formed between the reinforcement and the matrix. The amorphous alloy-reinforced and toughened AMC has a smooth surface without any defects such as cracks, and its microstructure has small porosity, desirable overall density, and evenly-distributed amorphous alloy.

The present disclosure further provides a method for preparing the amorphous alloy-reinforced and toughened AMC as described in the above technical solutions, including the following steps:

(1) mixing a powder of the aluminum-based alloy with the amorphous alloy to obtain a third mixed powder; and
(2) subjecting the third mixed powder obtained in step (1) to continuous extrusion and heat treatment sequentially to obtain the amorphous alloy-reinforced and toughened AMC.

In the present disclosure, a powder of the aluminum-based alloy is mixed with the amorphous alloy to obtain a third mixed powder.

In some embodiments, the powder of the aluminum-based alloy has a particle size of greater than or equal to 200 mesh. Controlling the particle size of the powder of the aluminum-based alloy within the above range could further reduce the porosity during subsequent continuous extrusion, thereby improving the compactness of the composite.

In some embodiments, in step (1), the mixing is conducted in a V-type powder mixer. In some embodiments, the mixing is conducted for 30 min to 60 min. There is no special limitation on a specific model of the V-type powder mixer, and commercially available products well known to those skilled in the art may be used.

In the present disclosure, after obtaining the third mixed powder, the third mixed powder is subjected to continuous extrusion and heat treatment sequentially to obtain the amorphous alloy-reinforced and toughened AMC.

In some embodiments, the continuous extrusion is conducted in a single-roll continuous extrusion machine, a twin-roll continuous extrusion machine, a powder single-roller mill or a powder double-roller mill. There is no special limitation on models of the above equipments, and commercially available products well known to those skilled in the art may be used.

In some embodiments, the continuous extrusion is conducted at a rotational speed of 4 rpm to 10 rpm, preferably 4 rpm to 7 rpm. In some embodiments, the continuous extrusion is conducted with a strain capacity of greater than 1. Through continuous extrusion of the third mixed powder, under the action of friction, the third mixed powder is broken and welded into a rod-shaped billet, achieving a desirable metallurgical effect of the amorphous alloy and aluminum-based alloy; in addition, the composite interface of the amorphous alloy wrapped by the aluminum-based alloy has good binding property without any macro defect, and the reinforced aluminum-based alloy interface could also be well bonded. By controlling the parameters of the continuous extrusion, the large plastic deformation provided by the continuous extrusion could result in a bonding interface of the amorphous alloy densely wrapped with the aluminum-based alloy, and reduce micro-crack generation and cascade connection at the interface junction under a load. This facilitates obtaining a core-shell structure of the composite interface of amorphous alloy particles-aluminum-based alloy after subsequent heat treatment, and further promotes a simultaneous improvement of strength and toughness on the amorphous alloy-reinforced aluminum-based alloy.

In the present disclosure, a working mechanism of the continuous extrusion is shown in FIG. 1. It can be seen from FIG. 1 that a mixed powder is poured into an extrusion wheel groove of a continuous extrusion machine, and the mixed powder is continuously fed into a mold cavity for accumulation; the extrusion wheel continues to rotate, and under the action of friction, the mixed powder is broken and welded into a rod shape.

In some embodiments, the heat treatment is conducted by heating an extruded material obtained after the continuous extrusion to a treating temperature, and holding at the treating temperature under a pressure for a holding time; the treating temperature is in a range of 400° C. to 550° C., preferably 450° C. to 500° C., and more preferably 500° C.; the pressure is in a range of 30 MPa to 60 MPa, preferably 40 MPa to 50 MPa; the holding time is in a range of 5 min to 15 min, preferably 10 min; a heating rate to the treating temperature is in a range of 5° C./min to 15° C./min, preferably 10° C./min. In some embodiments, the heat treatment further includes cooling the extruded material by furnace cooling after holding at the treating temperature under a pressure for a holding time. Through the heat treatment, element diffusion could occur between the amorphous alloy and the aluminum-based alloy to form a low-defect (dislocation) transition interface with a core-shell structure, reducing a mismatch stress between the amorphous alloy and the aluminum-based alloy. Meanwhile, amorphous alloy particles also play a role in hindering the movement of dislocations, thereby improving the strength-toughness matching of AMC. By controlling parameters of the heat treatment, the temperature of the heat treatment is closer to the crystallization temperature of the amorphous alloy, and a certain number of crystallized shell layers are obtained at optimal temperature and holding time of the heat treatment to achieve a highly stable bonding interface, which further improves the stability of the composite.

In the present disclosure, the amorphous alloy-reinforced and toughened AMC is prepared by continuous extrusion, which has a short preparation process, low energy consumption, and high production efficiency, reducing a production cost of the AMC. Meanwhile, the preparation method has a high material utilization rate, strong blank adaptability, small equipment occupation, and low investment and equipment cost. The method is easy to realize automatic control during continuous production, which is suitable for large-scale industrial production.

The technical solutions of the present disclosure will be described below clearly and completely in conjunction with examples of the present disclosure. Apparently, the described examples are only a part of, not all of, the examples of the present disclosure. All other embodiments obtained by those of ordinary skill in the art based on the embodiments of the present disclosure without creative efforts shall fall within the protection scope of the present disclosure.

Example 1

An amorphous alloy-reinforced and toughened AMC consisted of 60 vol. % of an aluminum-based alloy and 40 vol. % of an amorphous alloy, wherein the amorphous alloy was $Fe_{52}Cr_{26}Mo_{18}B_2C_{12}$;

the aluminum-based alloy was Al-12Si; the aluminum-based alloy consisted of, in mass percentage: 12.0% of silicon, less than or equal to 0.05% of iron, and aluminum as a balance.

The amorphous alloy was prepared as follows:

1) an iron powder, a chromium powder, a molybdenum powder, a boron powder, and a carbon powder were mixed according to an atomic percentage of each atom of the amorphous to obtain a first mixed powder; and
2) stearic acid was added to the first mixed powder obtained in step 1) to obtain a second mixed powder, and the second mixed powder was subjected to mechanical alloying, obtaining the amorphous alloy, wherein stearic acid was used in an amount of 1.5 wt. % of the first mixed powder, and the mechanical alloying was conducted by ball milling with a ball-to-material ratio of 25:1 at 600 rpm for 150 h under an argon atmosphere.

A method for preparing the amorphous alloy-reinforced and toughened AMC was performed as follows:

(1) a powder of the aluminum-based alloy was mixed with the amorphous alloy in a V-type powder mixer for 30 min to obtain a third mixed powder; and
(2) the third mixed powder obtained in step (1) was subjected to continuous extrusion and heat treatment in sequence, obtaining the amorphous alloy-reinforced and toughened AMC, wherein the continuous extrusion was conducted at a rotational speed of 4 rpm and a strain capacity of greater than 1, the heat treatment was conducted by heating an extruded material obtained after the continuous extrusion to a treating temperature of 400° C. at a heating rate of 10° C./min, and holding at 400° C. under a pressure of 50 MPa for 5 min, and then cooling the extruded material by furnace cooling.

Example 2

Example 2 was conducted as Example 1 except that the treating temperature was 450° C.

Example 3

Example 3 was conducted as Example 1 except that the treating temperature was 500° C.

Example 4

Example 4 was conducted as Example 1 except that the treating temperature was 550° C.

The mechanical properties of the amorphous alloy-reinforced and toughened AMCs prepared according to Examples 1 to 4 were tested, and the results are shown in Table 1.

TABLE 1

Mechanical properties of the amorphous alloy-reinforced and toughened AMCs prepared according to Examples 1 to 4

| Example | Yield strength (MPa) | Elastic modulus (GPa) |
|---|---|---|
| Example 1 | 98 | 378.7 |
| Example 2 | 168 | 448.2 |
| Example 3 | 267 | 493.7 |
| Example 4 | 369 | 838.5 |

It can be seen from Table 1 that with an increase of the treating temperature of the heat treatment temperature, the mechanical properties of amorphous alloy-reinforced and toughened AMC gradually increases.

Figure 2:
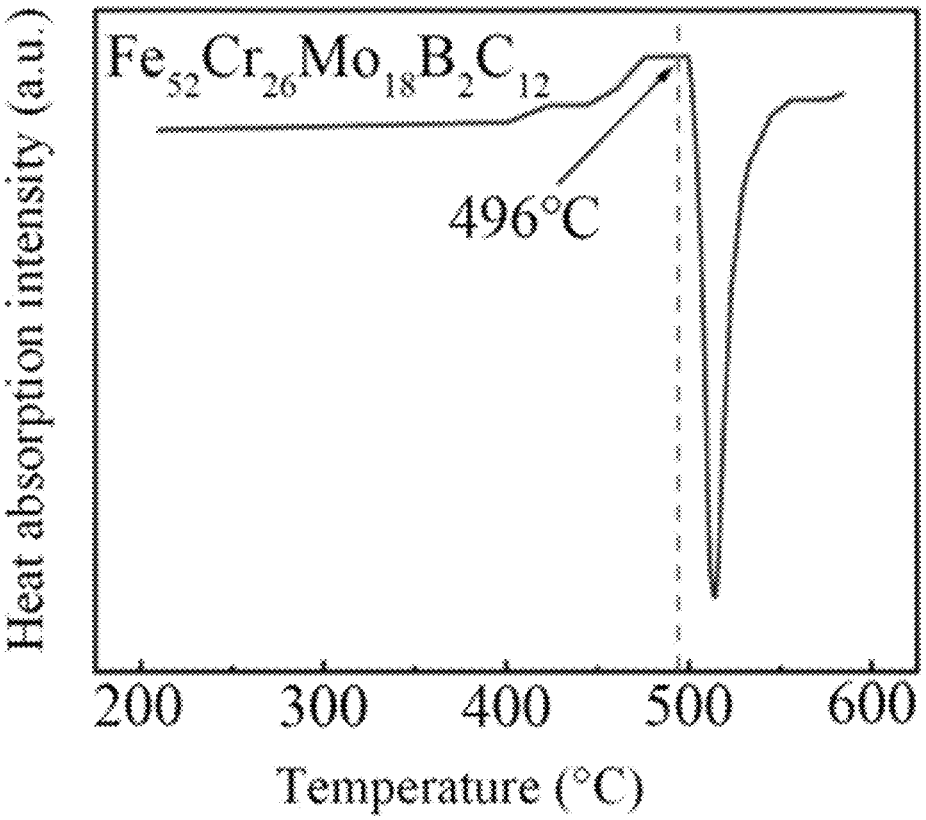
FIG. 2 shows an X-ray diffraction (XRD) pattern of the amorphous alloy prepared according to Example 1 of the present disclosure.

The amorphous alloy prepared according to Example 1 was detected by X-ray diffraction, and the obtained XRD pattern is shown in FIG. 2. It can be seen from FIG. 2 that the $Fe_{52}Cr_{26}Mo_{18}B_2C_{12}$ iron-based amorphous alloy has an amorphous phase.

Figure 3:
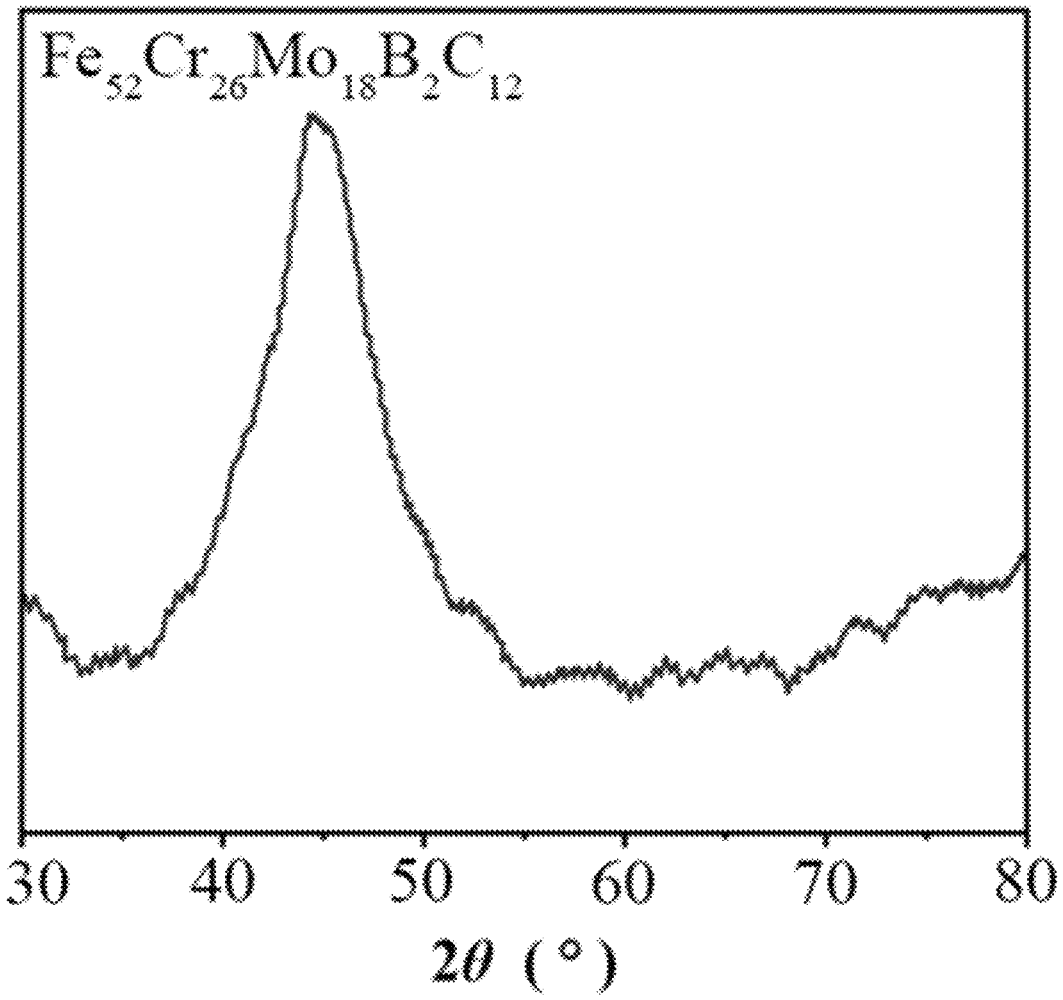
FIG. 3 shows a differential scanning calorimetry (DSC) pattern of the amorphous alloy prepared according to Example 1 of the present disclosure.

The amorphous alloy prepared according to Example 1 was tested by differential scanning calorimetry, and the obtained DSC pattern is shown in FIG. 3, wherein the ordinate in FIG. 3 represents a relative intensity (a.u.). It can be seen from FIG. 3 that the amorphous alloy has an initial crystallization temperature of 496° C.

Figure 4:
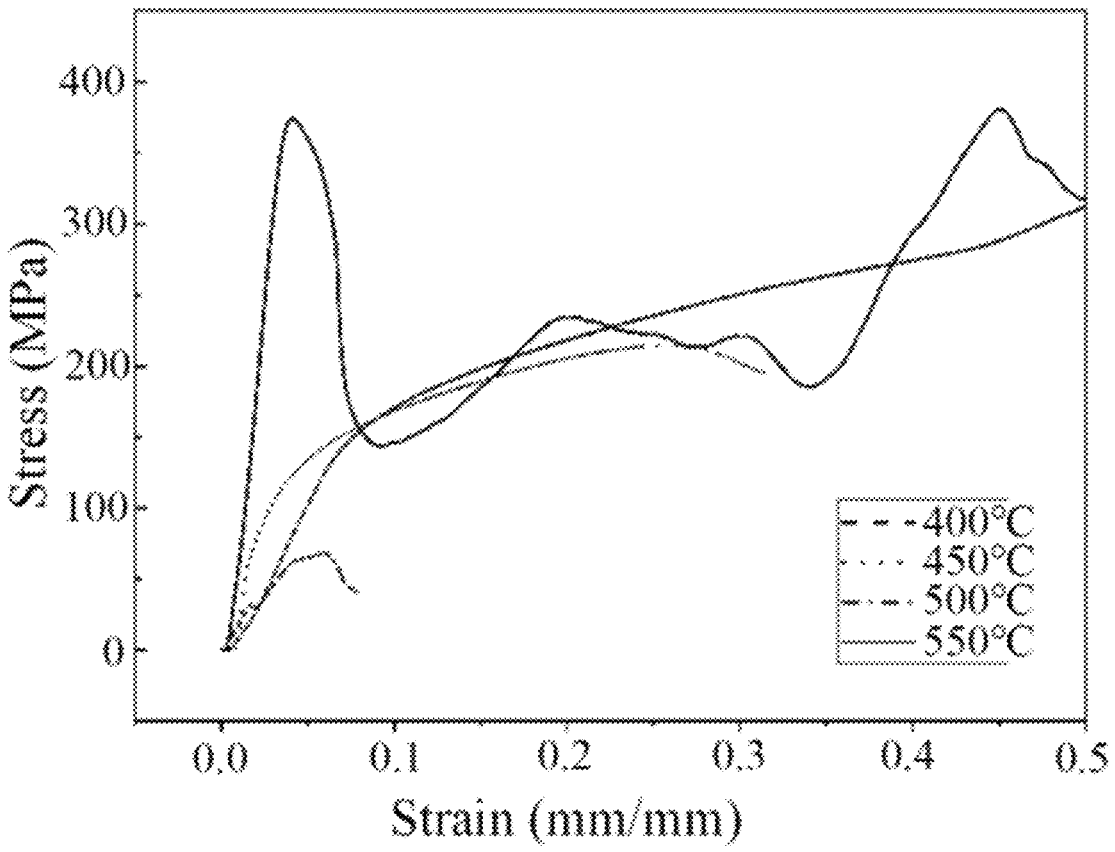
FIG. 4 shows yield strength variation curves of the amorphous alloy-reinforced and toughened AMCs prepared according to Examples 1 to 4 of the present disclosure.

Yield strength of the amorphous alloy-reinforced and toughened AMCs prepared according to Examples 1 to 4 was tested, and the results are shown in FIG. 4. It can be seen from FIG. 4 that as the treating temperature increases, the yield strength of the amorphous alloy-reinforced and toughened AMC also increases; however, when the treating temperature is 500° C., the composite has the best mechanical stability.

Figure 5:
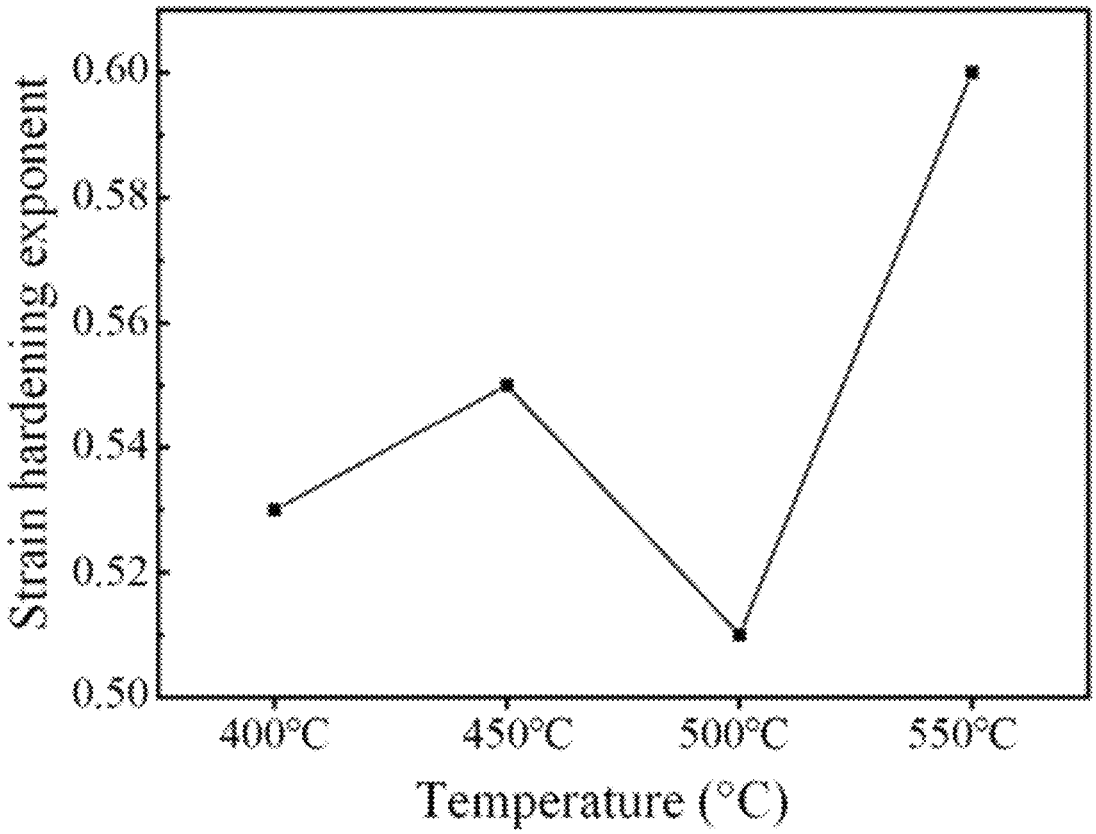
FIG. 5 shows strain hardening exponent variation curves of the amorphous alloy-reinforced and toughened AMCs prepared according to Examples 1 to 4 of the present disclosure.
Figure 6:
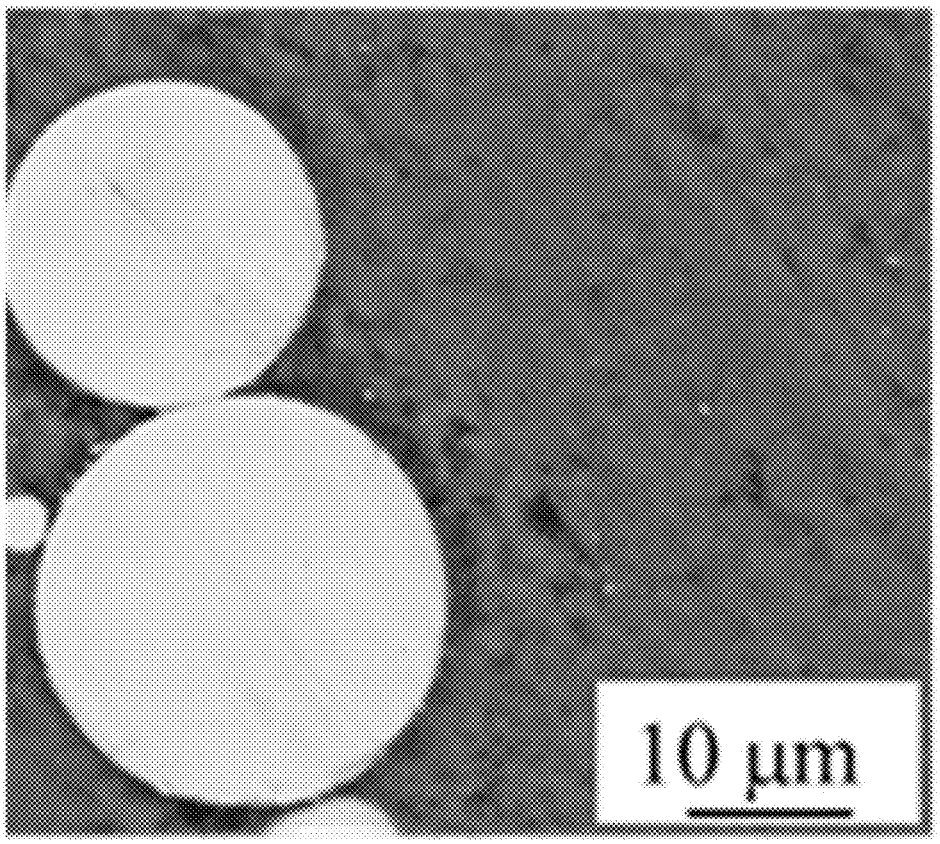
FIG. 6 shows a scanning electron microscopy (SEM) image of the amorphous alloy-reinforced and toughened AMC prepared according to Example 1 of the present disclosure.
Figure 7:
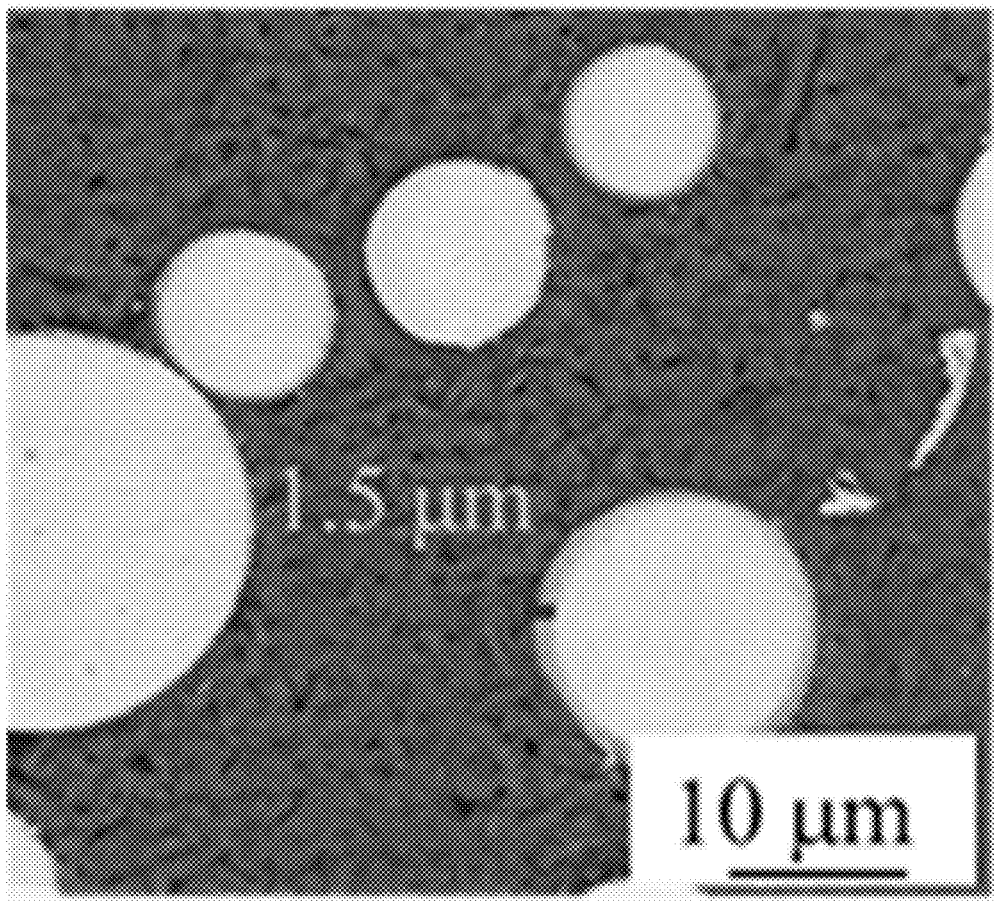
FIG. 7 shows an SEM image of the amorphous alloy-reinforced and toughened AMC prepared according to Example 2 of the present disclosure.
Figure 8:
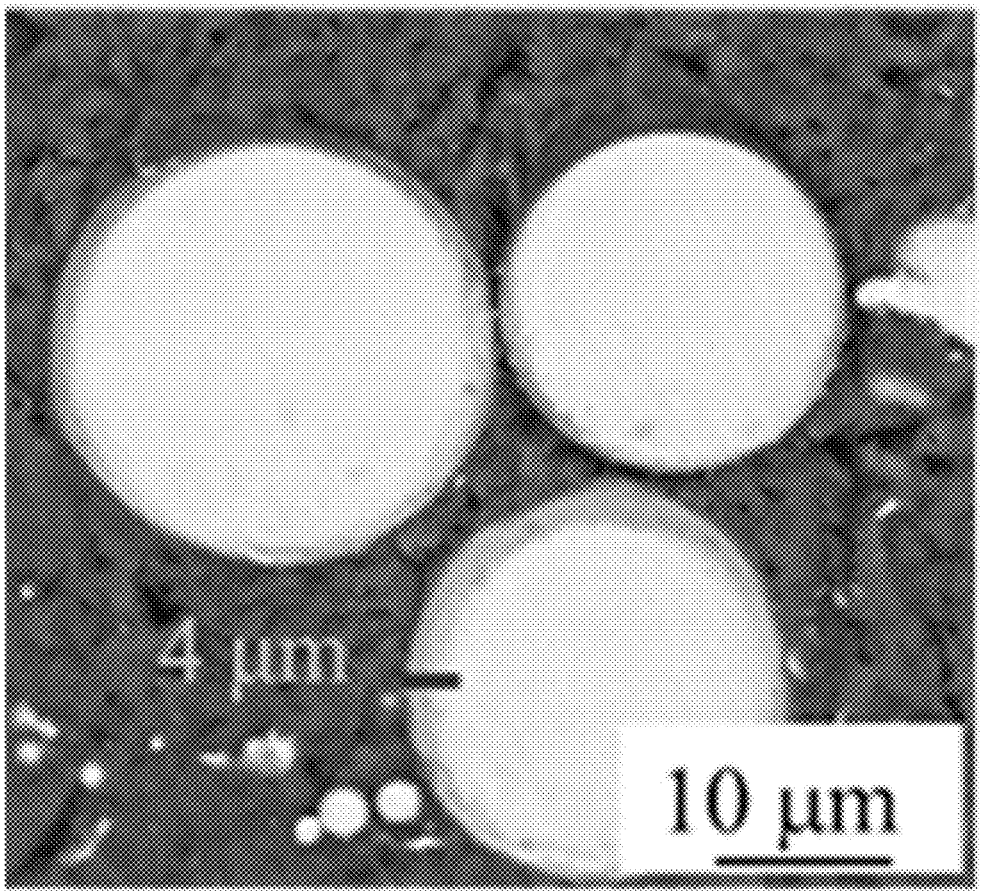
FIG. 8 shows an SEM image of the amorphous alloy-reinforced and toughened AMC prepared according to Example 3 of the present disclosure.
Figure 9:
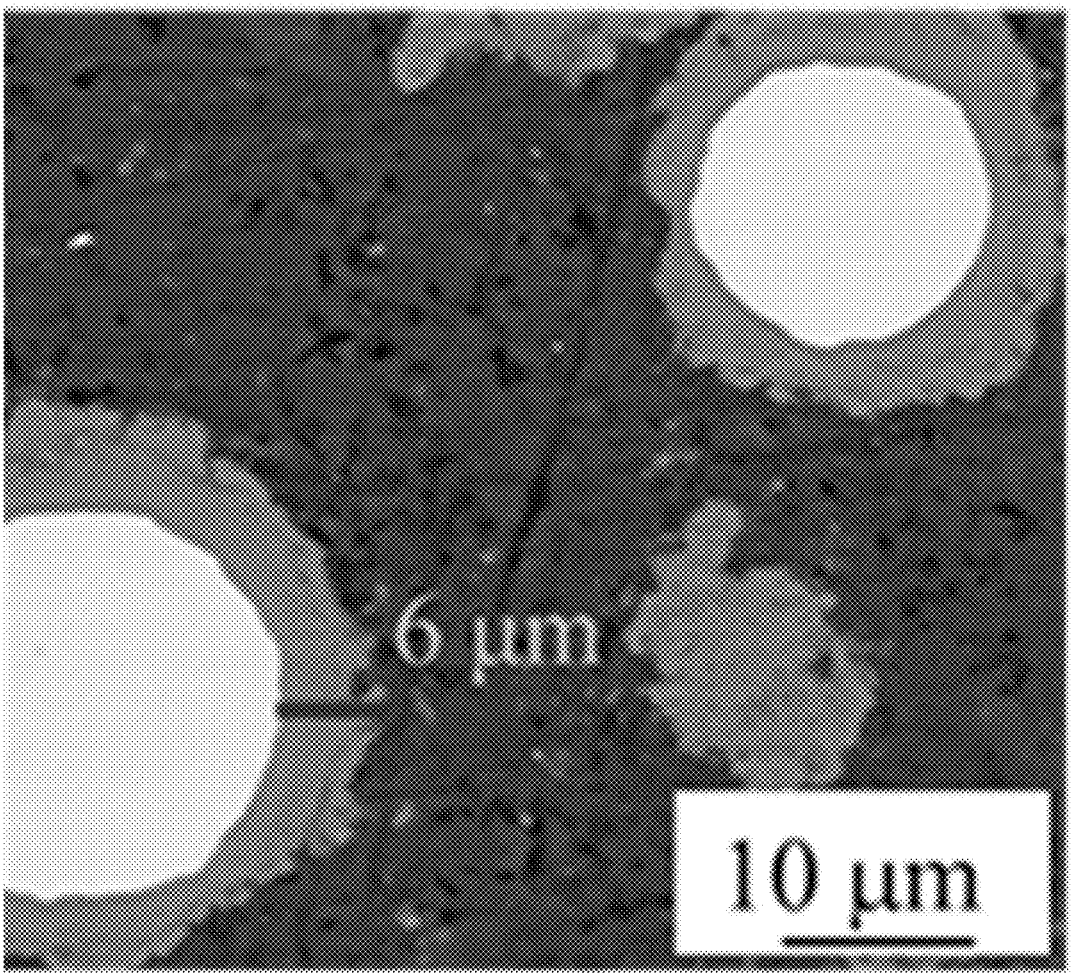
FIG. 9 shows an SEM image of the amorphous alloy-reinforced and toughened AMC prepared according to Example 4 of the present disclosure.
Figure 10:
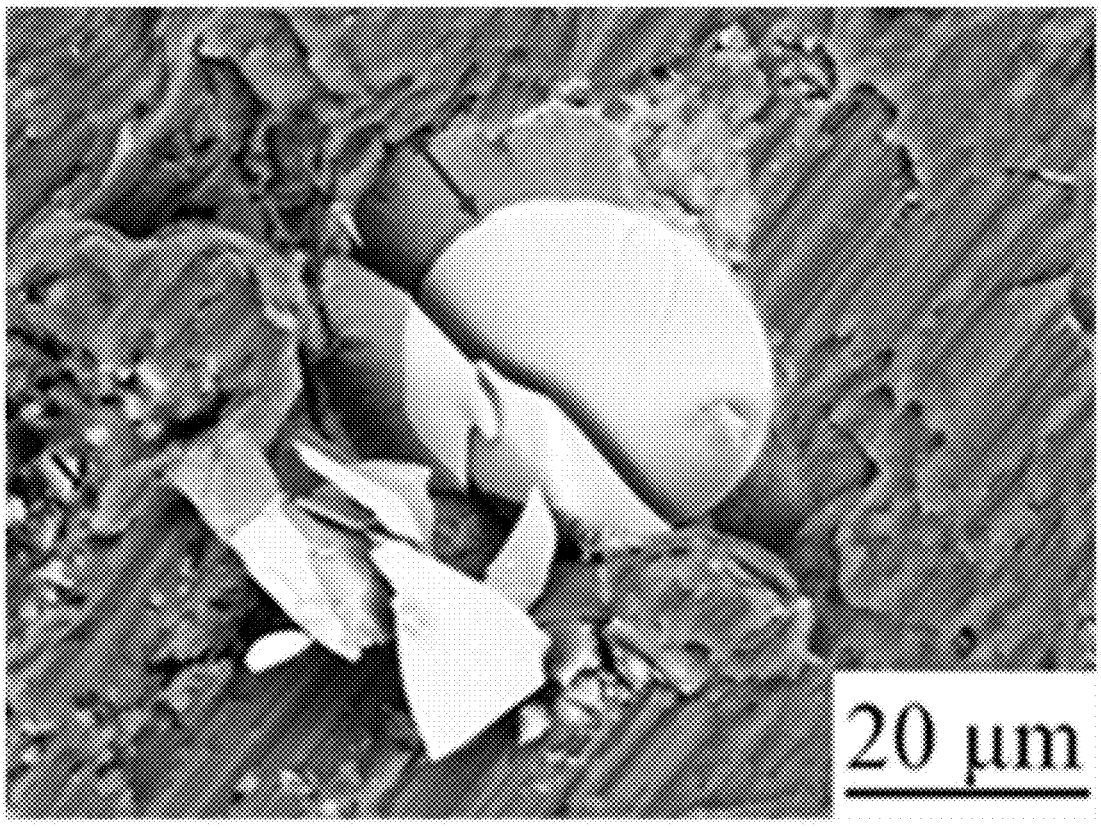
FIG. 10 shows morphology of a fracture of the amorphous alloy-reinforced and toughened AMC prepared according to Example 1 of the present disclosure.
Figure 11:
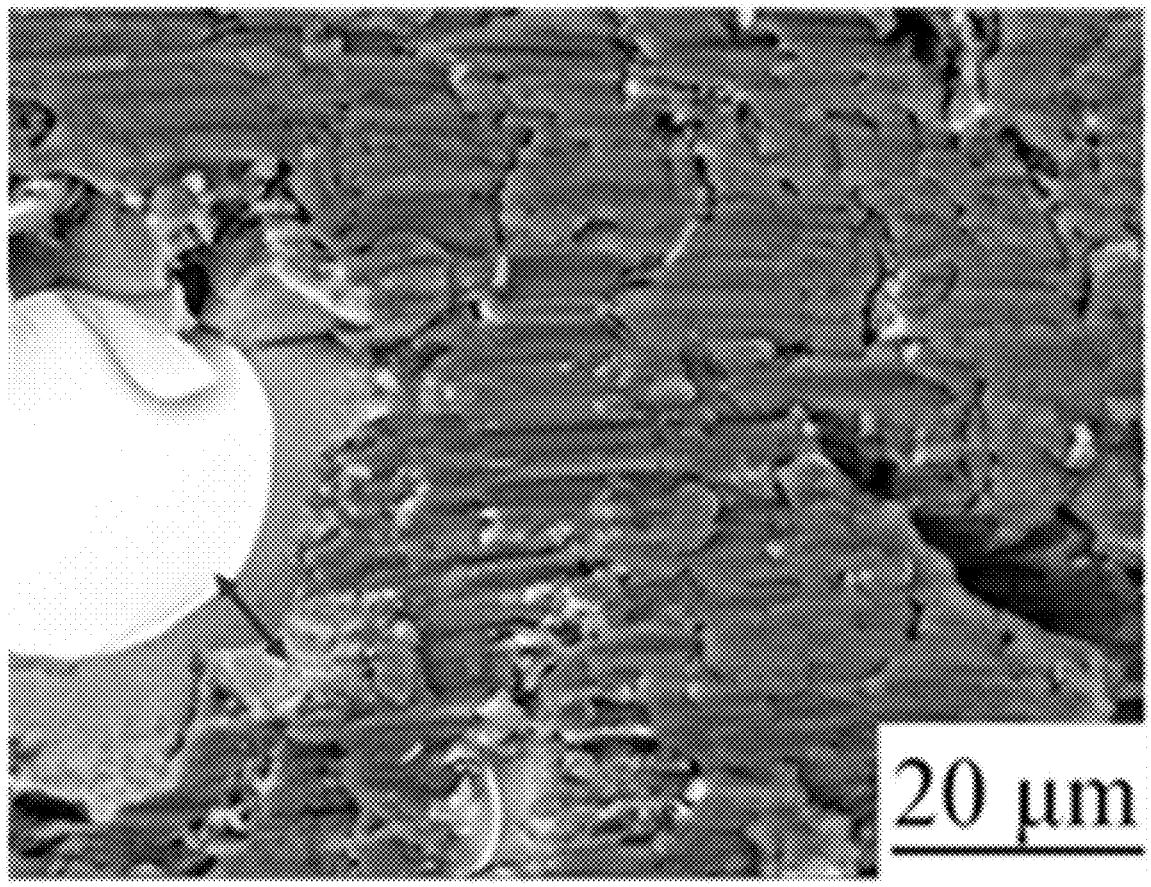
FIG. 11 shows morphology of a fracture of the amorphous alloy-reinforced and toughened AMC prepared according to Example 2 of the present disclosure.
Figure 12:
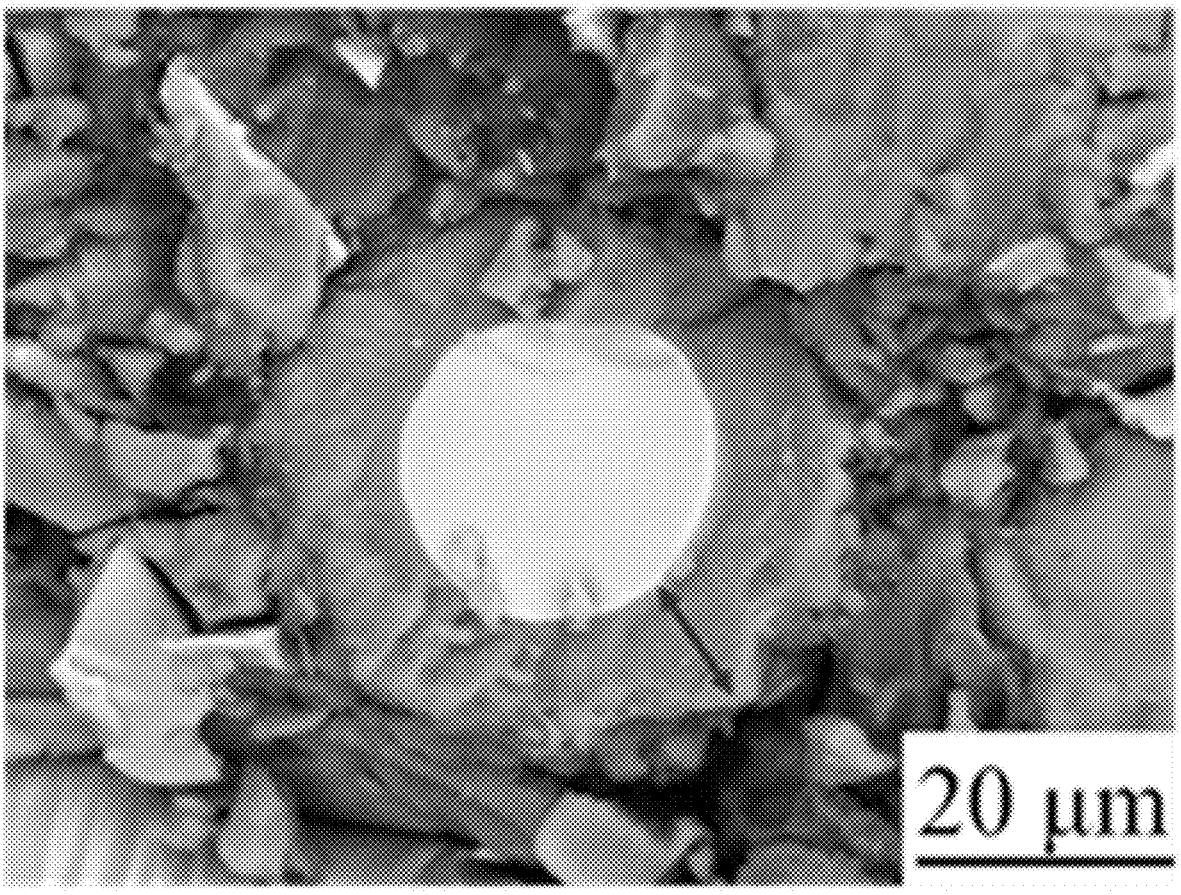
FIG. 12 shows morphology of a fracture of the amorphous alloy-reinforced and toughened AMC prepared according to Example 3 of the present disclosure.
Figure 13:
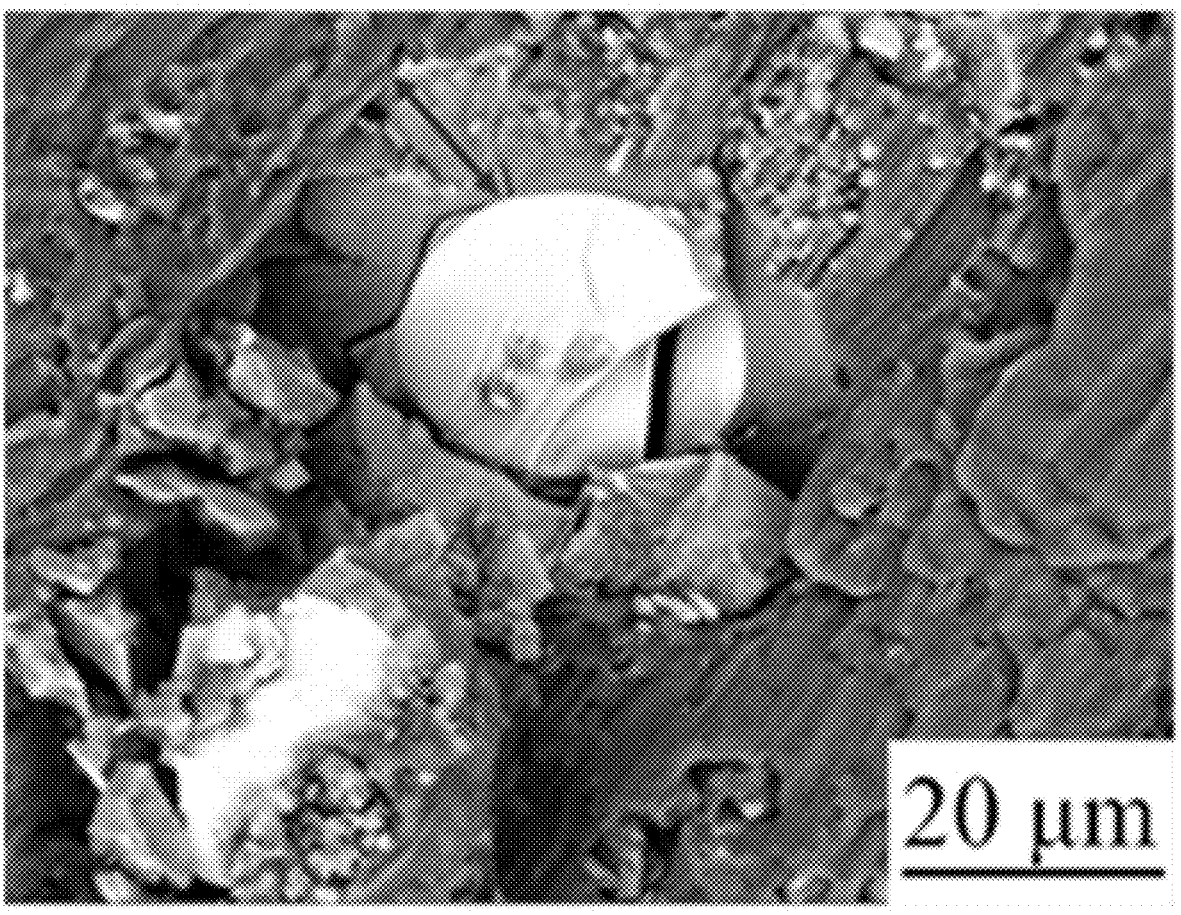
FIG. 13 shows morphology of a fracture of the amorphous alloy-reinforced and toughened AMC prepared according to Example 4 of the present disclosure.

The strain hardening exponents of the amorphous alloy-reinforced and toughened AMCs prepared according to Examples 1 to 4 are shown in FIG. 5. It can be seen from FIG. 5 that with an increase of the temperature of the heat treatment, the strain hardening exponent of the amorphous alloy-reinforced and toughened AMC shows a trend of first increasing, second decreasing and then increasing; and when the treating temperature is 500° C., the composite had the minimum strain hardening exponent and the best toughness.

The SEM images of the amorphous alloy-reinforced and toughened AMCs prepared according to Examples 1 to 4 are shown in FIGS. 6 to 9 in sequence. It can be seen from FIGS. 6 to 9 that as the treating temperature of the heat treatment increases, crystallized shells with different wall thicknesses formed on a surface of the amorphous alloy particles, elements diffused between the amorphous alloy particles and the aluminum-based alloy, and the crystallized shells gradually increase; when the treating temperature is 500° C., the interfacial bonding has the best stability.

The amorphous alloy-reinforced and toughened AMCs prepared according to Examples 1 to 4 were subjected to tensile fracture, and the fracture morphologies of obtained tensile fractures are shown in FIGS. 10 to 13 in sequence. It can be seen from FIGS. 10 to 13 that when the treating temperature is 450° C. and 500° C. separately, cracks in the sample mainly propagated in the aluminum-based alloy, there is no obvious fracture through amorphous particles, and it was more common for cracks to transect amorphous particles in this situation. This indicated that a certain crystallized shell could inhibit the tendency of cracks to generate inside or transect the particles.

Example 5

An amorphous alloy-reinforced and toughened AMC consisted of 90 vol. % of an aluminum-based alloy and 10 vol. % of an amorphous alloy, wherein the amorphous alloy was $Fe_{52}Cr_{26}Mo_{18}B_2C_{12}$;

the aluminum-based alloy was a commercially available 7075 aluminum alloy.

The amorphous alloy was prepared as follows:

1) an iron powder, a chromium powder, a molybdenum powder, a boron powder, and a carbon powder were mixed according to an atomic percentage of each atom of the amorphous alloy to obtain a first mixed powder; and
2) stearic acid was added to the first mixed powder obtained in step 1) to obtain a second mixed powder, and the second mixed powder was subjected to mechanical alloying, obtaining the amorphous alloy, wherein stearic acid was used in an amount of 1.5 wt. % of the first mixed powder, and the mechanical alloying was conducted by ball milling with a ball-to-material ratio of 30:1 at 600 rpm for 200 h under an argon atmosphere.

A method for preparing the amorphous alloy-reinforced and toughened AMC was performed as follows:

(1) a powder of the aluminum-based alloy was mixed with the amorphous alloy in a V-type powder mixer for 30 min to obtain a third mixed powder; and
(2) the third mixed powder obtained in step (1) was subjected to continuous extrusion and a heat treatment in sequence, obtaining the amorphous alloy-reinforced and toughened AMC, wherein the continuous extrusion was conducted at a rotational speed of 5 rpm and a strain capacity of greater than 1, the heat treatment was conducted by heating an extruded material obtained after the continuous extrusion to a treating temperature of 480° C. at a heating rate of 10° C./min, holding at the treating temperature under a pressure of 50 MPa for 15 min, and then cooling the extruded material by furnace cooling.

Comparative Example 1

An AMC consisted of 96 wt. % of an aluminum-based alloy and 4 wt. % of $TiB_2$;

the aluminum-based alloy was a commercially available Al-9Si-3Cu-0.8Zn alloy.

The AMC was prepared through an Al—K2TiF6-KBF4 reaction system, specifically prepared by the following steps:

(1) a $K_2TiF_6$ powder and a $KBF_4$ powder were evenly mixed with a mass ratio of 1:1, and dehydrated in an inert gas (Ar)-containing drying oven at 200° C. for 2 h to obtain a mixed salt;
(2) industrial pure Al and pure Si were mixed according to a mass ratio, and melt in a resistance furnace to obtain a first melt at 850° C.;
(3) the mixed salt obtained in step (1) was added to a bottom of the first melt obtained in step (2) under the protection of an inert gas (Ar), and mixed for 30 min by stirring to obtain a mixed melt;
(4) hexachloroethane refining agent was added to the mixed melt obtained in step (3) to remove slag; when the mixed melt was at 730° C., it was poured into a graphite mold, and air-cooled to a ambient temperature to obtain a 11 wt. % $TiB_2$/Al-6Si composite; and
(5) the 11 wt. % $TiB_2$/Al-6Si composite obtained in step (4), industrial pure Al, pure Si, pure Zn, and Al-50% Cu were melted in a resistance furnace according to a mass ratio, held at 850° C., and then added with $C_2Cl_6$ wrapped in an aluminum foil for slag removal to obtain a second melt; when the temperature of the second melt dropped to 730° C., the second melt was cast into a graphite mold and cooled naturally, obtaining an AMC.

Figure 14:
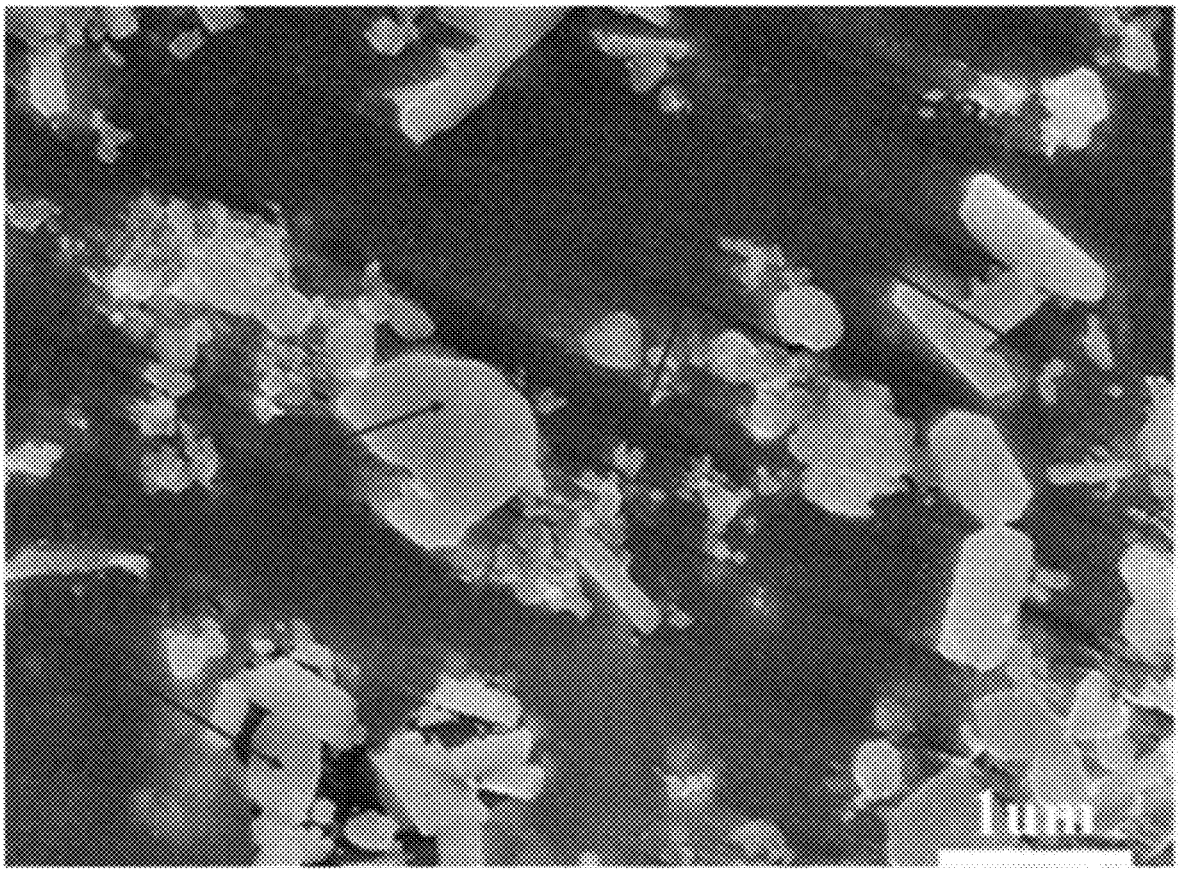
FIG. 14 shows an SEM image of the AMC obtained according to Comparative Example 1.

An SEM image of the AMC obtained according to Comparative Example 1 is shown in FIG. 14. It can be seen from FIG. 14 that the AMC prepared according to Comparative Example 1 has a relatively large primary Si size; after adding $TiB_2$, eutectic Si was in a shape of long needles or laths with sharp edges, showing a poor degree of homogenization; in addition, an $Al_2Cu$ phase in the matrix was coarse.

Figure 15:
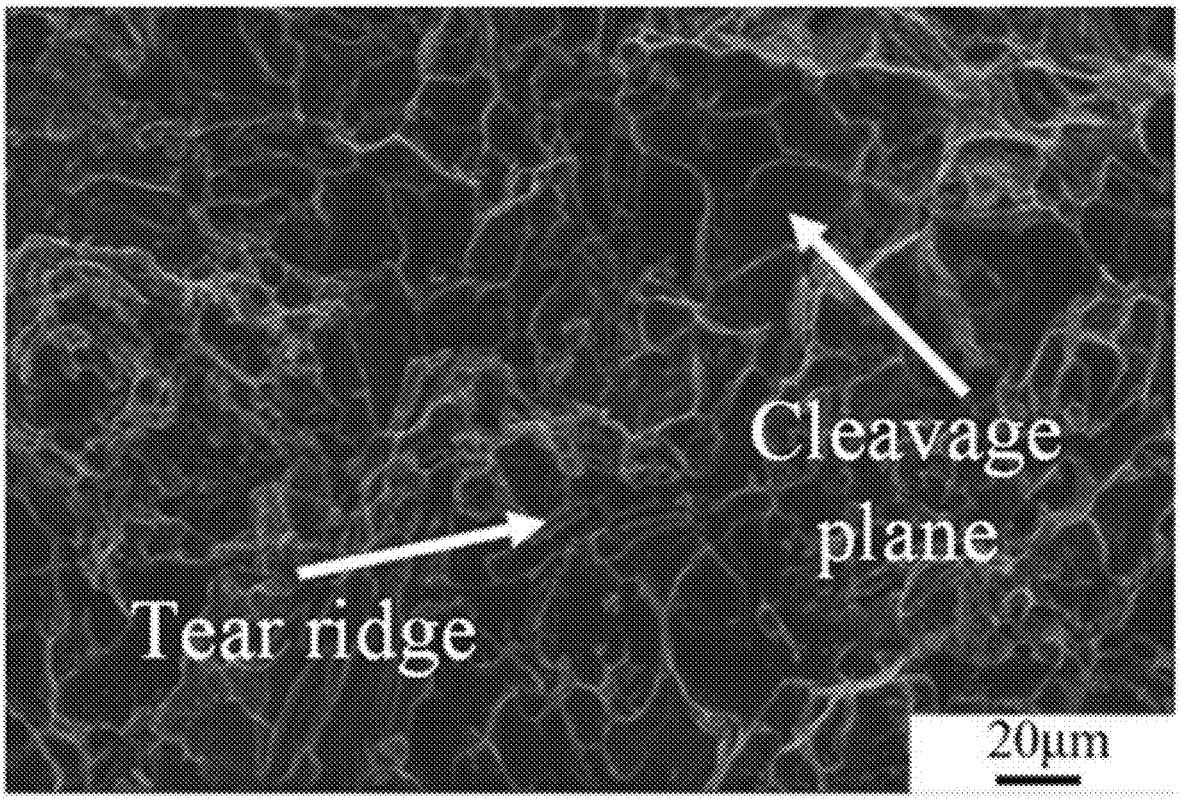
FIG. 15 shows morphology of a fracture of the AMC obtained according to Comparative Example 1.

The AMC prepared according to Comparative Example 1 was subjected to tensile fracture, and a fracture morphology of the obtained tensile fracture is shown in FIG. 15. It can be seen from FIG. 15 that there are many cleavage planes in the fracture of the AMC prepared according to Comparative Example 1, and the cleavage planes occupy relatively large area; in addition, a large number of tear ridges are observed. Therefore, the matrix alloy belongs to a typical cleavage fracture mechanism and has poor stability.

From the comparison of Examples 1 to 5 and Comparative Example 1, it can be seen that the amorphous alloy-reinforced and toughened AMC prepared according to the present disclosure has better interface stability and toughness, thus realizing simultaneous improvement of strength and toughness.

The above descriptions are merely preferred embodiments of the present disclosure. It should be noted that a person of ordinary skill in the art may further make several improvements and modifications without departing from the principle of the present disclosure, but such improvements and modifications shall be deemed as falling within the protection scope of the present disclosure.

What is claimed is:

1. A method for preparing an amorphous alloy-reinforced and toughened aluminum matrix composite (AMC), comprising the following steps:

(1) mixing a powder of an aluminum-based alloy with an amorphous alloy to obtain a third mixed powder; and
(2) subjecting the third mixed powder obtained in step (1) to continuous extrusion and heat treatment sequentially to obtain the amorphous alloy-reinforced and toughened AMC, wherein the amorphous alloy-reinforced and toughened AMC comprises 55 vol. % to 95 vol. % of an aluminum-based alloy and 5 vol. % to 45 vol. % of an amorphous alloy, wherein the amorphous alloy is $Fe_{52}Cr_{26}Mo_{18}B_2C_{12}$.

2. The method of claim 1, wherein in step (2), the continuous extrusion is conducted at a rotational speed of 4 rpm to 10 rpm and a strain capacity of greater than 1.

3. The method of claim 1, wherein in step (2), the heat treatment is conducted by heating an extruded material obtained after the continuous extrusion to a treating temperature of 400° ° C. to 550° C., and holding at the treating temperature under a pressure of 30 MPa to 60 MPa for 5 min to 15 min.

4. The method of claim 1, wherein the amorphous alloy-reinforced and toughened AMC comprises 60 vol. % to 90 vol. % of the aluminum-based alloy and 10 vol. % to 40 vol. % of the amorphous alloy.

5. The method of claim 1, wherein the amorphous alloy-reinforced and toughened AMC comprises 70 vol. % to 80 vol. % of the aluminum-based alloy and 20 vol. % to 30 vol. % of the amorphous alloy.

6. The method of claim 1, wherein the aluminum-based alloy comprises one selected from the group consisting of Al-12Si, a 7075 aluminum alloy, and an Al-9Si-3Cu-0.8Zn alloy.

7. The method of claim 1 further comprising the following steps:

1) mixing an iron powder, a chromium powder, a molybdenum powder, a boron powder, and a carbon powder according to an atomic percentage of each atom of the amorphous alloy to obtain a first mixed powder; and 2) adding a protective agent to the first mixed powder obtained in step 1) to obtain a second mixed powder, and subjecting the second mixed powder to mechanical alloying to obtain the amorphous alloy.

8. The method of claim 7, wherein in step 2), the protective agent is stearic acid, and is used in an amount of 1 wt. % to 2 wt % of the first mixed power, and the mechanical alloying is conducted by ball milling in an inert atmosphere.

* * * * *